US008734201B2

(12) United States Patent
Nuttall et al.

(10) Patent No.: US 8,734,201 B2
(45) Date of Patent: May 27, 2014

(54) TOY VEHICLE RACETRACK WITH PAIRED OBSTACLES

(75) Inventors: Michael Wayne Nuttall, South Pasadena, CA (US); Brendon Vetuskey, Long Beach, CA (US)

(73) Assignee: Mattel, Inc., El Segundo, CA (US)

( * ) Notice: Subject to any disclaimer, the term of this patent is extended or adjusted under 35 U.S.C. 154(b) by 421 days.

(21) Appl. No.: 13/097,957

(22) Filed: Apr. 29, 2011

(65) Prior Publication Data

US 2011/0269371 A1 Nov. 3, 2011

Related U.S. Application Data

(60) Provisional application No. 61/330,206, filed on Apr. 30, 2010.

(51) Int. Cl.

| | |
|---|---|
| ***A63H 18/00*** | (2006.01) |
| ***A63F 9/14*** | (2006.01) |
| ***A63H 18/02*** | (2006.01) |

(52) U.S. Cl.

CPC ..... *A63H 18/026* (2013.01); *A63H 18/005* (2013.01); *A63H 18/025* (2013.01); *A63F 9/14* (2013.01)

USPC ..... 446/444; 446/429; 446/431; 446/445; 463/58; 463/59; 463/60; 463/69; 116/223; 116/303

(58) Field of Classification Search

CPC ..... A63H 18/02; A63H 18/00; A63H 18/026; A63H 18/005; A63F 9/14

USPC ..... 446/429, 431, 444, 445; 463/58, 69, 59, 463/60; 116/223, 303

See application file for complete search history.

(56) References Cited

U.S. PATENT DOCUMENTS

| | | | |
|---|---|---|---|
| 1,278,203 | A | 9/1918 | Pierce |
| 1,462,189 | A | 7/1923 | Brooker |
| 1,493,649 | A | 5/1924 | Schulz |
| 1,662,162 | A | 3/1928 | Nestor |
| 2,161,314 | A | 6/1939 | King et al. |
| 2,726,869 | A | 12/1955 | Schulte |
| 2,736,556 | A | 2/1956 | Dasher |
| 2,853,301 | A | 9/1958 | Glass |
| 3,209,491 | A | 10/1965 | Roeper |

(Continued)

FOREIGN PATENT DOCUMENTS

| | | |
|---|---|---|
| DE | 3106081 | 8/1982 |
| DE | 3106123 | 8/1982 |
| WO | 2007131212 | 11/2007 |

OTHER PUBLICATIONS

USPTO, Office Action for U.S. Appl. No. 11/744,781; Mailing Date Dec. 18, 2008; 19 pages. Application issued as US 7,651,398 on Jan. 26, 2010.

(Continued)

*Primary Examiner* — Gene Kim
*Assistant Examiner* — Alexander Niconovich
(74) *Attorney, Agent, or Firm* — Kolisch Hartwell, PC

(57) ABSTRACT

A toy vehicle racetrack is provided with one or more obstacle pairs. The obstacle pairs may be arranged in a geometrical progression and each obstacle pair may determine the relative positions of two toy vehicles and impede the travel of the trailing vehicle. Impeding the travel of the trailing vehicle may be accomplished by ejecting the trailing toy vehicle from the track.

20 Claims, 7 Drawing Sheets

(56) References Cited

U.S. PATENT DOCUMENTS

| | | | | | |
|---|---|---|---|---|---|
| 3,315,632 | A | | 4/1967 | Hyden | |
| 3,376,844 | A | * | 4/1968 | Wood | 116/223 |
| 3,456,596 | A | * | 7/1969 | Cooper | 104/60 |
| 3,496,674 | A | | 2/1970 | Cooper | |
| 3,502,332 | A | * | 3/1970 | Wolf | 463/69 |
| 3,589,055 | A | | 6/1971 | Stormon | |
| 3,618,947 | A | * | 11/1971 | Cooper et al. | 463/60 |
| 3,712,615 | A | | 1/1973 | Staats et al. | |
| 3,777,394 | A | | 12/1973 | Staats et al. | |
| 3,858,875 | A | * | 1/1975 | Nemeth et al. | 273/460 |
| 4,077,628 | A | * | 3/1978 | Hebert | 463/69 |
| 4,108,437 | A | * | 8/1978 | DeAnda et al. | 463/59 |
| 4,153,250 | A | | 5/1979 | Anthony | |
| 4,185,409 | A | | 1/1980 | Cheng | |
| 4,273,332 | A | | 6/1981 | Buck et al. | |
| 4,285,157 | A | | 8/1981 | Lambert | |
| 4,349,983 | A | | 9/1982 | Kilroy et al. | |
| 4,355,807 | A | * | 10/1982 | Prehodka | 463/63 |
| 4,364,566 | A | * | 12/1982 | Neuhierl | 463/6 |
| 4,366,374 | A | * | 12/1982 | Neuhierl | 235/93 |
| 4,383,688 | A | * | 5/1983 | Prehodka | 238/10 F |
| 4,472,905 | A | * | 9/1984 | Silverman et al. | 446/444 |
| 4,513,966 | A | | 4/1985 | Mucaro et al. | |
| 4,550,910 | A | * | 11/1985 | Goldfarb et al. | 104/305 |
| 4,605,229 | A | * | 8/1986 | McKay | 463/59 |
| 4,661,080 | A | | 4/1987 | Goldstein et al. | |
| 4,715,602 | A | * | 12/1987 | May et al. | 463/60 |
| 4,872,680 | A | * | 10/1989 | Dennis | 463/59 |
| 4,937,207 | A | | 6/1990 | Simmell et al. | |
| 5,174,569 | A | | 12/1992 | Ngai | |
| 5,403,004 | A | | 4/1995 | Kennedy | |
| 5,452,893 | A | | 9/1995 | Faulk et al. | |
| 5,542,668 | A | | 8/1996 | Casale et al. | |
| 5,651,736 | A | * | 7/1997 | Myers | 463/64 |
| 5,683,298 | A | * | 11/1997 | Jackson | 463/58 |
| 5,813,351 | A | | 9/1998 | Chen | |
| 6,099,380 | A | | 8/2000 | Rasmussen | |
| 6,227,932 | B1 | | 5/2001 | Ngai | |
| 6,343,972 | B1 | * | 2/2002 | Ogawa et al. | 446/444 |
| 6,358,112 | B1 | | 3/2002 | Lambert et al. | |
| 6,386,538 | B1 | | 5/2002 | Mejia | |
| 6,517,007 | B2 | | 2/2003 | Kong | |
| 6,647,893 | B1 | | 11/2003 | Fugitt et al. | |
| 6,913,508 | B2 | * | 7/2005 | Hornsby et al. | 446/438 |
| 7,241,223 | B1 | * | 7/2007 | Caudill | 463/62 |
| 7,285,035 | B1 | * | 10/2007 | Tullis | 446/444 |
| 7,537,509 | B2 | | 5/2009 | Payne et al. | |
| 7,601,068 | B1 | * | 10/2009 | McGee | 463/58 |
| 7,628,674 | B2 | * | 12/2009 | Nuttall et al. | 446/444 |
| 7,637,796 | B2 | * | 12/2009 | Hippely | 446/429 |
| 7,651,398 | B2 | * | 1/2010 | Ostendorff et al. | 463/60 |
| 7,690,964 | B2 | * | 4/2010 | Nuttall et al. | 446/444 |
| 7,766,720 | B2 | * | 8/2010 | Ostendorff | 446/444 |
| 8,267,738 | B2 | * | 9/2012 | Nuttall | 446/444 |
| 2005/0287919 | A1 | * | 12/2005 | Sheltman et al. | 446/444 |
| 2007/0149090 | A1 | * | 6/2007 | Hippely | 446/445 |
| 2007/0293122 | A1 | * | 12/2007 | O'Connor et al. | 446/429 |
| 2008/0009224 | A1 | * | 1/2008 | Nuttall et al. | 446/444 |
| 2008/0014832 | A1 | * | 1/2008 | Ostendorff et al. | 446/444 |
| 2008/0268743 | A1 | * | 10/2008 | O'Connor et al. | 446/429 |
| 2009/0072481 | A1 | * | 3/2009 | Ostendorff | 273/246 |

OTHER PUBLICATIONS

USPTO, Final Office Action for U.S. Appl. No. 11/744,781; Mailing Date Jun. 24, 2009; 15 pages. Application issued as US 7,651,398 on Jan. 26, 2010.

The International Bureau of WIPO, Ellen Moyse, Authorized Officer; International Preliminary Report on Patentability for PCT/US2007/068306; mailing date Nov. 13, 2008; 4 pages.

* cited by examiner

TOY VEHICLE RACETRACK WITH PAIRED OBSTACLES

RELATED APPLICATION

This application claims priority under 35 U.S.C. §119 and applicable foreign and international law of U.S. Provisional Patent Application Ser. No. 61/330,206 filed Apr. 30, 2010 which is hereby incorporated by reference in its entirety.

BACKGROUND OF THE DISCLOSURE

People of all ages enjoy playing with toy vehicles. MATCHBOX® and HOTWHEELS® toy vehicles, for example, have been enjoyed by children and collectors alike since the mid 20th Century.

Toy vehicles may be enjoyed with accessories including play structures incorporating tracks, roadways, and other structures configured for toy vehicle play. Examples of play structures with tracks for toy vehicles are disclosed in U.S. Pat. Nos. 7,651,398, 6,913,508, 6,647,893, 6,358,112, 6,099,380, 4,349,983, and 4,077,628. Examples of finish order indicators are disclosed in U.S. Pat. Nos. 5,651,736, 4,715,602, 3,618,947, 3,502,332, 3,376,844, 3,315,632, and 1,662,162. Examples of tracks for toy vehicles with ejectors or trap doors are disclosed in U.S. Pat. Nos. 7,628,674, 7,537,509, 5,683,298, and 1,493,649, The disclosures of these and all other publications referenced herein are incorporated by reference in their entirety for all purposes.

SUMMARY OF THE DISCLOSURE

Toy vehicle racetracks according to the present disclosure include a plurality of lanes configured to provide traveling surfaces for toy vehicles. The racetracks may also include a starting gate, one or more vehicle obstacle pairs, and a finish line gate. In some examples, for each pair of track lanes, an obstacle pair is configured such that it determines the relative position of two vehicles passing over it on the paired pathways and ejects the trailing vehicle from the surface of the track, allowing the lead vehicle to continue unimpeded. Alternatively, an obstacle may be configured to impede vehicle progress in some other fashion, such as physically stopping it by blocking the lane. The racetracks may have one or more of these obstacle pairs, arranged in a geometric progression with each successive plurality of paired obstacles being followed by a reduction of the traveling lanes by one-half, such that for any given pair of tracks, only the leading car will proceed down the remaining one lane.

By this mechanism, the plurality of lanes at the starting gate may eventually be reduced to two lanes or, in a preferred embodiment, to a single lane, with only the winning toy vehicle reaching a finish line gate. A finish line gate may also be configured to indicate finishing order or that a toy vehicle has passed through victoriously.

Examples of a racetrack may include any combination of two different types of unlatching assembly for the obstacles. A first type, also referred to as the immediate type, may substantially immediately trigger an ejector portion in the opposing lane. This type is generally intended to be utilized where the trailing vehicle is expected to be on the obstacle when the lead vehicle triggers the system.

A second type of unlatching assembly, also referred to as the delay type, may be configured with an arming mechanism, whereby a lead toy vehicle arms the obstacle pair such that ejection is only triggered by a trailing vehicle when the trailing vehicle later arrives. This type is generally intended to be utilized where the trailing vehicle may not yet be located on the obstacle when the first vehicle arrives. An essentially instant-ejector in that situation may not result in consistent trailing vehicle ejection, and it may be more appropriate to include an ejector with delayed unlatching. In some example racetracks, immediate unlatching is utilized for obstacles near the start of the racetrack, while delayed unlatching is utilized for obstacles near the end of the racetrack, where vehicles have had time to create more significant leads. In other examples, immediate unlatching is utilized throughout.

Examples of the toy vehicle racetracks may also be configured to be collapsed or folded into a travel configuration for easy transportation and storage. In a deployed configuration, the racetrack may be configured at an angle such that a general downward slope is achieved from the starting gate to the finish line gate, with the final portion or segment intended to lie flat against a surface such as a table or floor. A final portion or segment may also be configured to allow a user to connect additional track portions.

In some examples, a racetrack begins with four traveling lanes consisting of two side-by-side pairs. Following one set of ejector obstacles essentially equidistant from the starting gate, the four lanes narrow to become two lanes. At some distance farther down the track, there is a second set of ejector obstacles. Following the second obstacles, the two lanes narrow to become one lane, which may narrow further to funnel a winning toy vehicle through a finish line gate.

DETAILED DESCRIPTION

Figure 1:
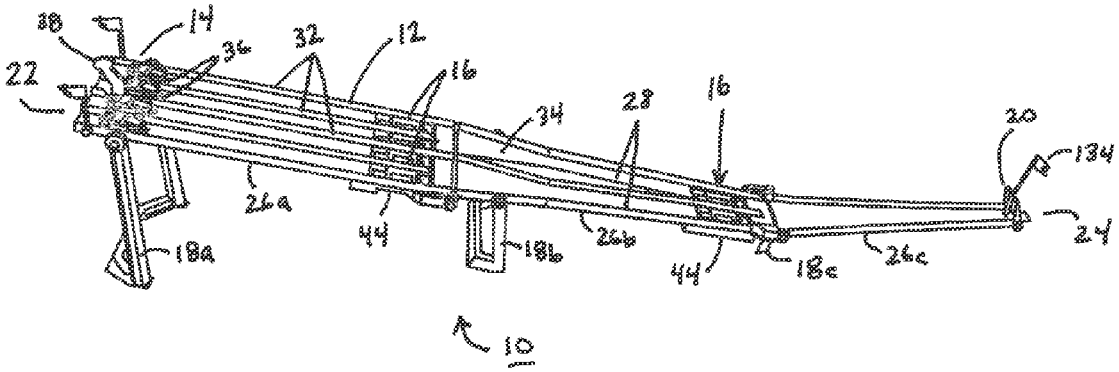
FIG. 1 shows a perspective view of a toy vehicle racetrack with ejector obstacles in a deployed configuration.

An example of a toy vehicle racetrack is shown generally at 10 in FIG. 1. Unless otherwise specified, toy vehicle racetrack 10 may, but is not required to contain at least one of the structure, components, functionality, and/or variations described, illustrated, and/or incorporated herein. Toy vehicle racetrack 10 may include track 12, starting gate 14, one or more obstacle pairs 16, support members 18, and/or finishing gate 20. As shown in FIG. 1, track 12 may extend from a first end 22 to a second end 24 and may include a plurality of track portions or segments 26 and a plurality of lanes 28. In some examples, track segments 26 include three hingeably attached portions or segments, shown in FIG. 1 as track segment 26*a*, track segment 26*b*, and track segment 26*c*. Each one of track segments 26 may include one or more lanes 28 configured to guide and facilitate racing of toy vehicles on track 12.

In some examples, each one of lanes 28 is defined by substantially parallel ribs 32 and divided traveling surface 34. Ribs 32 define the peripheral boundaries of each one of lanes 28, and are sized to substantially keep a toy vehicle in one of lanes 28 from straying into a neighboring one of lanes 28. Ribs 32 may also be configured such that two of lanes 28 converge into one of lanes 28, for example following an obstacle pair 16 as shown in FIG. 1.

Obstacle Pairs

FIG. 1 shows an illustrative racetrack 10 with obstacle pairs 16 disposed substantially in line with corresponding pairs of lanes 28 in various locations such that obstacle pairs 16 will be encountered by toy vehicles racing down track 12. Obstacle pairs 16 may be any suitable pair of obstacles operatively linked together, configured to be triggered or armed by a toy vehicle in one of lanes 28, and to impede the travel of a trailing toy vehicle in a another one of lanes 28. For example, travel of a trailing toy vehicle may be impeded by an obstacle that physically ejects a trailing toy vehicle from traveling surface 34.

Figure 2:
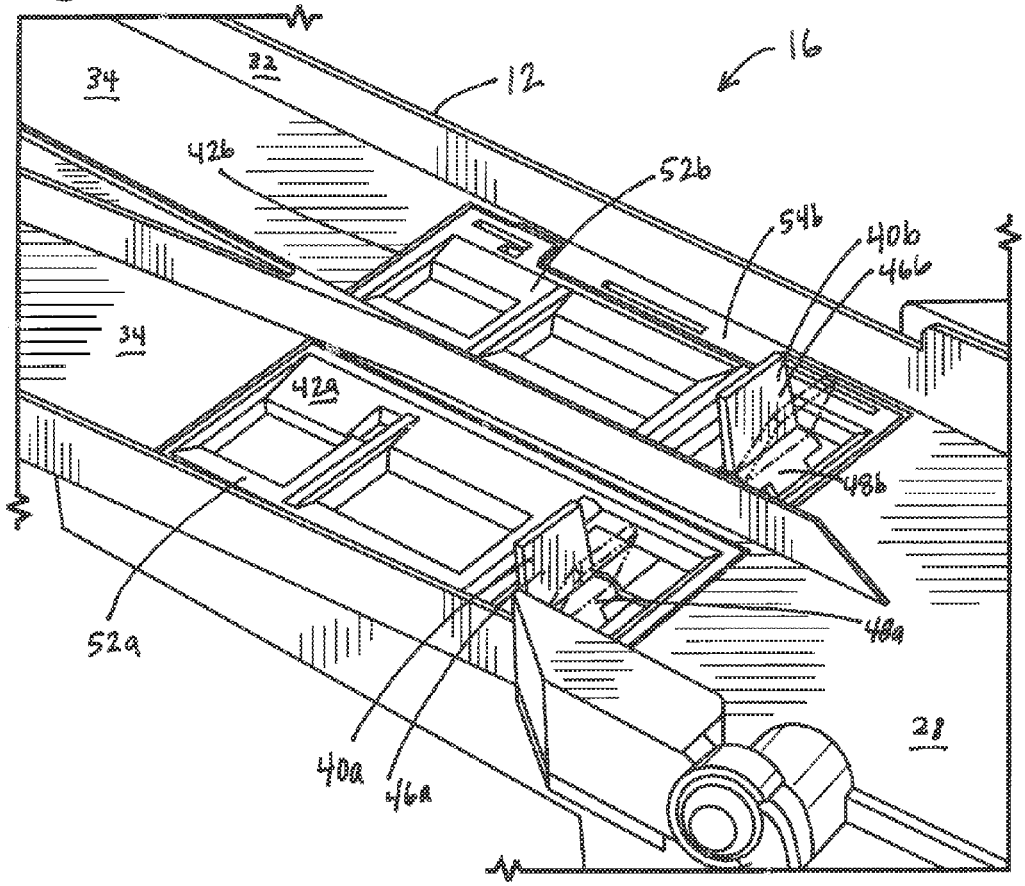
FIG. 2 shows a perspective view of an ejector obstacle pair.
Figure 3:
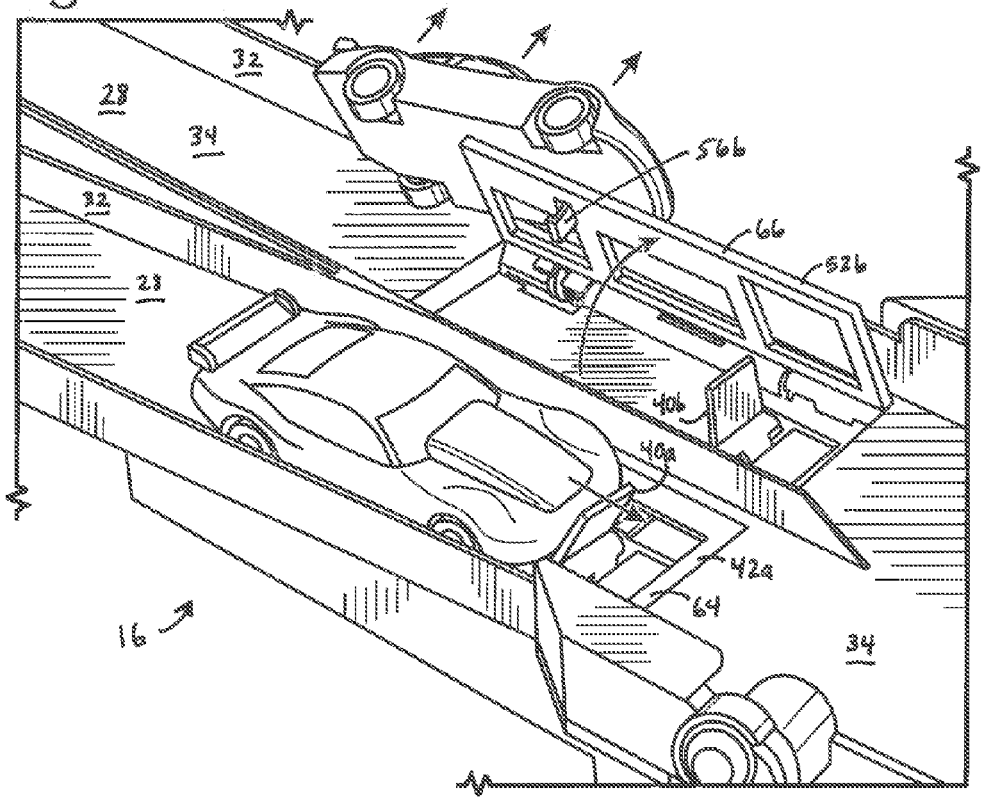
FIG. 3 shows a perspective view of an ejector obstacle pair, with a leading toy vehicle proceeding down one lane and a trailing toy vehicle being ejected from the traveling surface of the other lane.

FIG. 2 shows an illustrative one of obstacle pairs 16 in a first position. FIG. 3 shows the same one of obstacle pairs 16 having been activated by a leading toy vehicle and consequently ejecting a trailing toy vehicle from traveling surface 34 by repositioning to a second position. The example in FIG. 2 (further described below) includes hinged ejector obstacles. Alternatively, obstacles may include ejector obstacles with hinges on a different edge or without hinges altogether. In other examples, obstacles may include wall-like structures or trapping devices such as net shaped objects or trap doors.

In the example shown in FIGS. 2 and 3, each one of obstacle pairs 16 includes two triggers such as trigger 40*a* and trigger 40*b*, two obstacles such as ejector 42*a* and ejector 42*b*, and an unlatching assembly 44. Trigger 40*a* and trigger 40*b* may be any suitable structure configured to be activated by a toy vehicle on traveling surface 34 and to consequently activate unlatching assembly 44. In this example, trigger 40*a* and trigger 40*b* are vertical mechanical triggers with cam portions. Alternatively, horizontal gate-like structures may be used. Trigger 40*a* and 40*b* may include substantially the same components. Therefore an illustrative trigger 40*a* will be described and a corresponding description of trigger 40*b* may be understood by substituting suffix "b" for suffix "a" on the corresponding reference numerals (i.e., 40*b*, 46*b*, 48*b*, 50*b*, 51*b*).

Figure 5:
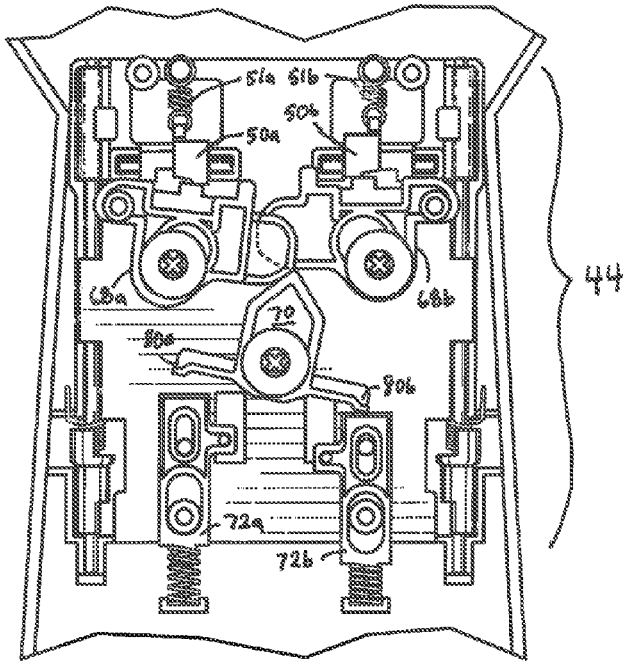
FIG. 5 shows the unlatching assembly of FIG. 4 in an activated or triggered state.
Figure 4:
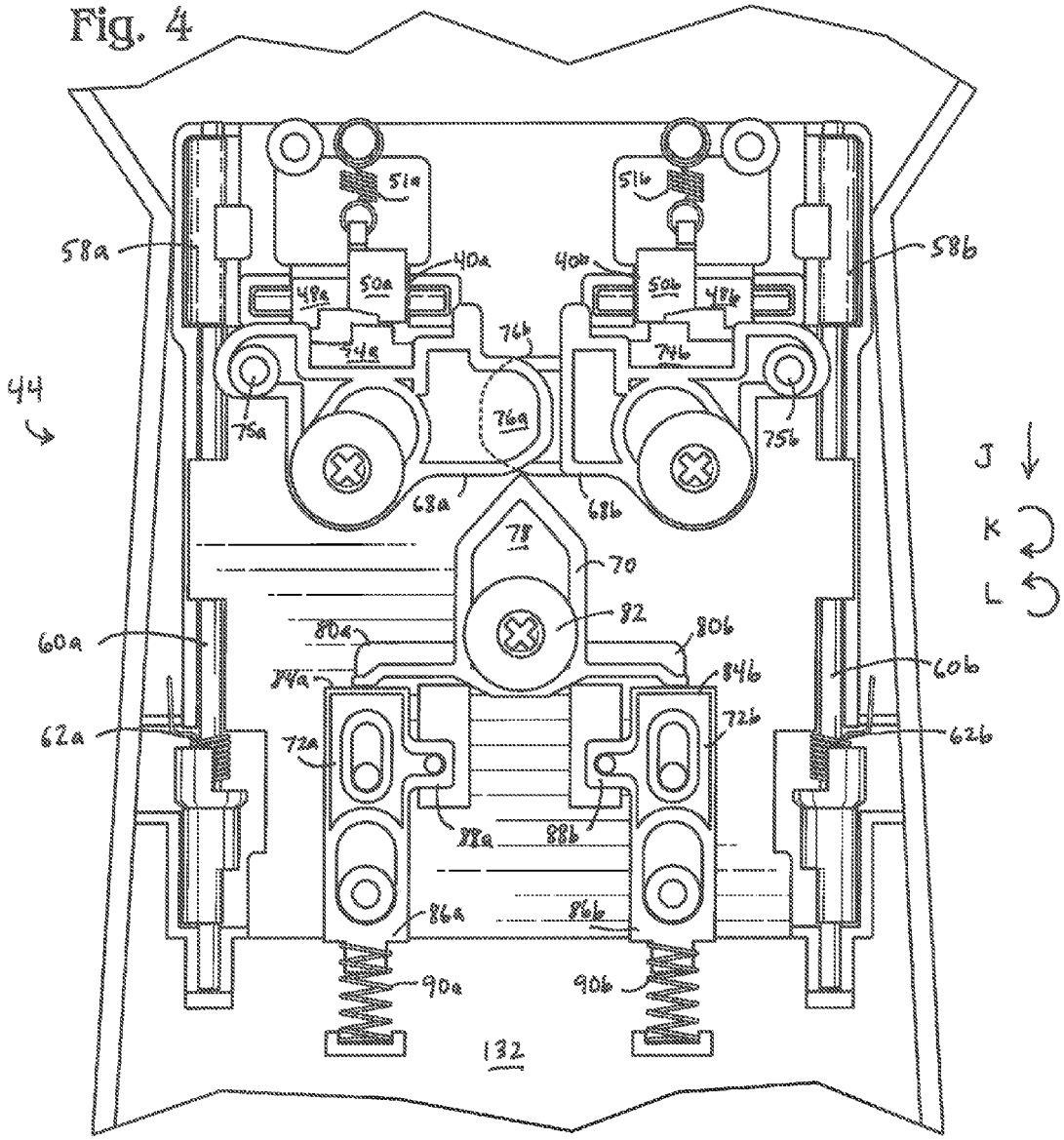
FIG. 4 shows a plan view of an immediate type of unlatching assembly located on the underside of an ejector obstacle pair such as that shown in FIGS. 2 and 3.
Figure 6:
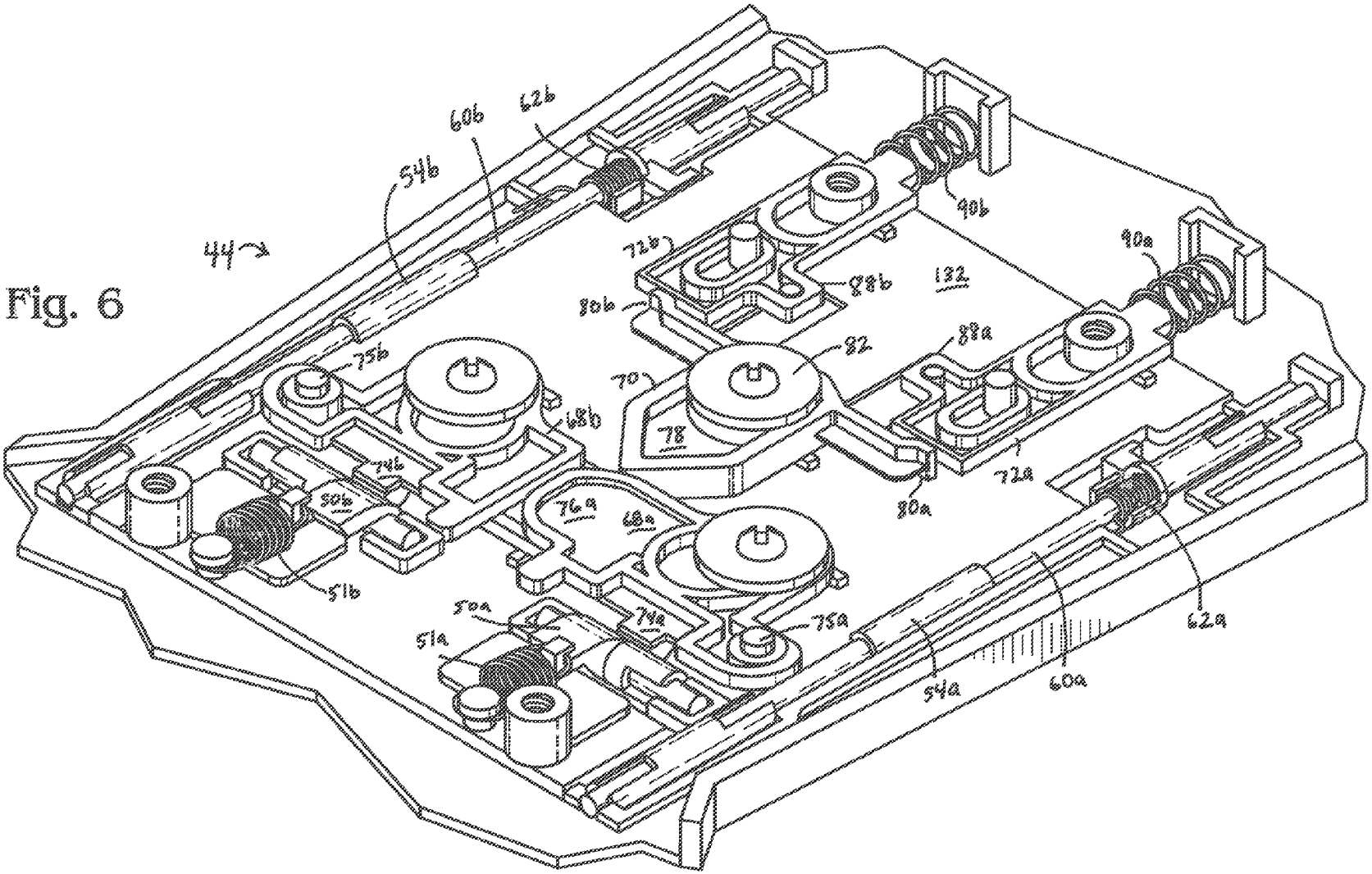
FIG. 6 shows a perspective view of the unlatching assembly of FIG. 4.

In some examples, trigger 40*a* includes tab portion 46*a*, hinge 48*a*, and/or cam portion 50*a*. Tab portion 46*a* may project through an opening in traveling surface 34 such that a passing toy vehicle will strike tab portion 46*a* and cause it to pivot downward and toward second end 24 of track 12. Each trigger may be hingeably attached to a surface of track 12, for example using hinge 48*a* as shown in FIGS. 4-10. Trigger 40*a* may also include a cam portion 50*a*, which may be any suitable structure configured to translate rotational motion of tab portion 46*a* into linear motion in a plane substantially parallel to traveling surface 34. For example, cam portion 50*a* may be a cam or a finger extending from hinge 48*a* which upon activation of trigger 40*a* may urge a nearby cam follower away from hinge 48*a*. Spring 51*a* may also be included, as shown in FIGS. 4-6, to ensure trigger 40*a* is elastically returned to a ready position, in which tab portion 46*a* may protrude above traveling surface 34 and cam portion 50*a* may be disengaged from an associated cam follower.

FIGS. 1, 2, and 3 also show ejector 42*a* and ejector 42*b*. Each ejector may be any suitable obstacle configured to impede the travel of a toy vehicle by ejecting the toy vehicle from traveling surface 34. Ejector 42*a* and ejector 42*b* may include substantially the same components. Therefore, an example of ejector 42*a* will be described and a corresponding description of ejector 42*b* may be understood by substituting suffix "b" for suffix "a" on the corresponding reference numerals (i.e., 52*b*, 54*b*, 56*b*, 58*b*, 60*b*, 62*b*).

In some examples, ejector 42*a* includes panel member 52*a*, spring-loaded panel hinge 54*a*, and latching hook 56*a*. Panel member 52*a* may be any suitable rigid or semi-rigid structure configured to transfer kinetic energy from an energy source such as a spring-loaded hinge to a toy vehicle disposed at least partially on its upper surface. In the example shown in FIGS. 2 and 3, panel member 52*a* is a rigid rectangular frame. Panel member 52*a* may be configured as a substantially planar structure to lay flat in a first position 64 in a recess or opening in traveling surface 34 so as not to impede toy vehicle travel.

Panel hinge 54*a* may be disposed on one edge of panel member 52*a*, and may be configured as one or more hinge knuckles 58*a* with a hinge pin 60*a*, and may also include an elastic member such as hinge spring 62*a*. An elastic member such as hinge spring 62*a* may be any suitable elastic member configured to reversibly convert potential to kinetic energy. For example, hinge spring 62*a* may be a helical spring disposed coaxially with hinge pin 60*a* as shown in FIGS. 4-10.

Latching hook 56*a* may be rigidly attached to or formed as an integral part of panel member 52*a*. Latching hook 56*a* may be any suitable structure configured to reversibly interlock with a corresponding structure in unlatching assembly 44 such that panel member 52*a* may be selectively retained in first position 64 (e.g., latched) or released to allow repositioning to second position 66 (e.g., open). For example, latching hook 56*a* may be a claw-, L-, or hook-shaped member protruding substantially orthogonally from an edge or surface of panel member 52*a* as shown in FIG. 3.

Unlatching assembly 44 acts to operatively connect trigger 40*a* and trigger 40*b* with ejector 42*a* and ejector 42*b*. As will become clear, the appended reference letters "a" and "b" in this case indicate where each component may be located, but are not necessarily intended to indicate how or when the triggers and ejectors are operatively connected.

Immediate Type of Unlatching Assembly

FIGS. 4, 5, and 6 show an illustrative first type of unlatching assembly 44, also referred to as an "immediate" type, as seen from an underside of track 12 corresponding to a similar location on the reverse side of track 12 shown in FIGS. 2 and 3. For purposes of illustration, a protective and cosmetically pleasing cover plate (not shown) typically fastened over an unlatching assembly 44 has been removed to show various components. For purposes of discussion, various directions are designated on FIG. 4 as capital letters J, K, and L. As described above, the immediate type of unlatching assembly 44 is configured such that when a trigger in one lane is activated, an ejector in the opposite lane is unlatched substantially immediately.

In some examples, the immediate type of unlatching assembly 44 includes cam follower 68*a*, cam follower 68*b*, toggle member 70, retention/release latch 72*a*, and retention/release latch 72*b*. Using an illustrative immediate type of unlatching assembly 44, a sequence of operations from an activation of trigger 40*a* to a repositioning of ejector 42*b* is now described.

Trigger 40*a* may be activated when a passing first toy vehicle strikes tab portion 46*a*, causing trigger 40*a* to pivot on hinge 48*a* against the restraining force of spring 51*a* and causing cam portion 50*a* to urge first edge 74*a* of cam follower 68*a* in direction J. Cam follower 68*a* is configured to pivot on pivot pin 75*a*, causing tongue 76*a* of cam follower 68*a* to rotate in direction K. Tongue 76*a* then strikes toggle end 78 of toggle member 70, urging toggle end 78 in direction K. Toggle member 70 is configured to pivot on pivot post 82, causing rocker arm 80*b* to strike first end 84*b* of retention/release latch 72*b*. This urges retention/release latch 72*b* in direction J against a resistive force of spring 90*b*. FIG. 5 shows a plan view of the previously described components in positions corresponding to a triggered state.

Latching arm 88*b* may be configured with a retention claw (not shown) which may be an L-shaped appendage designed to interlock with associated latching hook 56*b* through an opening in track 12. When retention/release latch 72*b* is urged in direction J, latching arm 88*b* is caused to also move in direction J, in turn causing the retention claw to disengage from latching hook 56*b* and release ejector 42*b*. Because ejector 42*b* is biased toward second position 66 by hinge spring 62*b*, disengagement of latching hook 56*b* allows panel member 52*b* to forcibly reposition from first position 64 (latched) to second position 66 (open). As a result, a second toy vehicle, a portion of which may be disposed on panel member 52*b*, is thereby forcibly ejected from traveling surface 34.

Turning to a scenario where the toy vehicle roles are reversed, a similar sequence of events from an activation of trigger 40*b* to a repositioning of ejector 42*a* is now described. Trigger 40*b* may be activated when a passing first toy vehicle strikes tab portion 46*b*, causing trigger 40*b* to pivot against the restraining force of spring 51*b* on hinge 48*b* and causing cam portion 50*b* to urge first edge 74*b* of cam follower 68*b* in direction J. Cam follower 68*b* is configured to pivot on pivot pin 75*b*, causing tongue 76*b* (obscured in FIG. 4 by cam follower 68*a*) to rotate under tongue 76*a* in direction L. Tongue 76*b* then strikes toggle end 78 of toggle member 70, urging toggle end 78 in direction L. Toggle member 70 is configured to pivot on pivot post 82, causing rocker arm 80*a* to strike first end 84*a* of retention/release latch 72*a*. This urges retention/release latch 72*a* in direction J against a resistive force of spring 90*a*.

Latching arm 88*a* may be configured with a retention claw (not shown) which may be an L-shaped appendage designed to interlock with associated latching hook 56*a* through an opening in track 12. When retention/release latch 72*a* is urged in direction J, latching arm 88*a* is caused to also move in direction J, in turn causing the retention claw to disengage from latching hook 56*a* and release ejector 42*a*. Because ejector 42*a* is biased toward second position 66 by hinge spring 62*a*, disengagement of latching hook 56*a* allows panel member 52*a* to forcibly reposition from first position 64 (latched) to second position 66 (open). As a result, a second toy vehicle, a portion of which may be disposed on panel member 52*a*, is thereby forcibly ejected from traveling surface 34.

Delay Type of Unlatching Assembly

FIGS. 7, 8, 9, and 10 show an illustrative second type of unlatching assembly 44, also referred to as a "delay" type, as seen from an underside of track 12 corresponding to a similar location on the reverse side of track 12 shown in FIGS. 2 and 3. For purposes of illustration, a protective and cosmetically pleasing cover plate (not shown) typically fastened over an unlatching assembly 44 has been removed to show various components. For purposes of discussion, various directions are designated on FIG. 7 by reference letters C, D, E, F, G, and H. As described above, the delay type of unlatching assembly 44 may be configured such that unlatching assembly 44 begins in an unarmed state. When a trigger in a first lane is activated, unlatching assembly 44 may be placed into an armed state such that a subsequent activation of a trigger in a second lane causes substantially immediate unlatching of the ejector in the second lane.

In some examples, the delay type of unlatching assembly 44 includes cam follower plate 92*a*, cam follower plate 92*b*, arming shuttle 94, arming shuttle latch 96, retention/release latch 98*a*, and retention/release latch 98*b*. Utilizing an example of a delay type unlatching assembly 44, a sequence of events from an activation of trigger 40*a* to a later repositioning of ejector 42*b* is now described.

Trigger 40*a* may be activated when a passing first toy vehicle strikes tab portion 46*a*, causing trigger 40*a* to pivot on hinge 48*a* and causing cam portion 50*a* to urge first edge 100*a* of cam follower plate 92*a* in direction C. In this example, instead of a spring 51*a* providing elastic resistance to pivoting of trigger 40*a*, spring 106*a* holds cam follower plate 92*a* against cam portion 50*a*, providing elastic resistance and positioning to both components. Cam follower plate 92*a* slidably repositions in direction C, causing angled arming member 102*a* to slide along interface post 108*a*, thereby translating displacement approximately ninety degrees and urging arming shuttle 94 in direction E against elastic resistance from centering spring 114.

Figure 8:
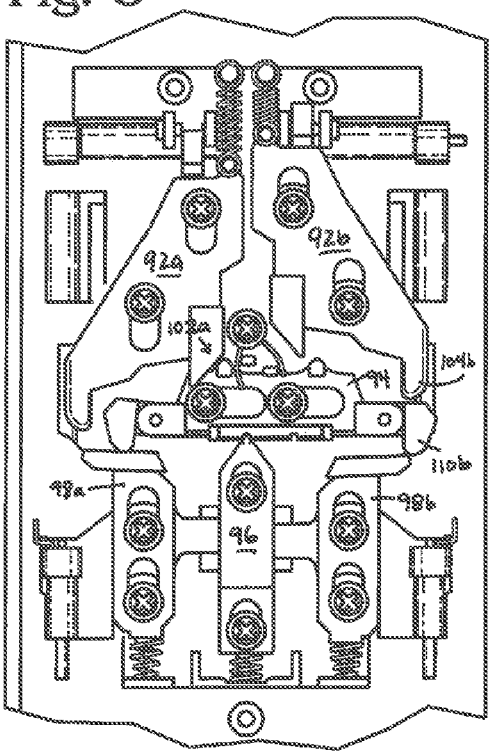
FIG. 8 shows the unlatching assembly of FIG. 7 in an intermittent, armed state.

Displacement of arming shuttle 94 causes arming notch 112*b* to align with first end 116 of shuttle latch 96. Shuttle latch 96 is biased in direction D by spring 120, resulting in mechanical engagement between first end 116 and arming notch 112*b* once alignment occurs. Mechanical engagement acts to retain arming shuttle 96 in a displaced position despite the biasing resistance of centering spring 114. The retained displacement of arming shuttle 94 also holds pivoting toggle 110*b* at one end of arming shuttle 94 in interposed alignment between firing finger 104*b* and retention/release latch 98*b*. This alignment operatively connects trigger 40*b* with ejector 42*b*. This example of a delay type unlatching assembly 44 is now in an intermediate armed state. FIG. 8 shows a plan view of the previously described components in positions corresponding to this armed state.

In this example, a subsequent activation of trigger 40*b*, such as by a second toy vehicle, causes trigger 40*b* to pivot on hinge 48*b* and causes cam portion 50*b* to urge first edge 100*b* of cam follower plate 92*b* in direction C. Cam follower plate 92*b* slides in direction C as cam follower plate 92*a* did in the previous arming phase. However, since firing finger 104*b* is now aligned with pivoting toggle 110*b*, firing finger 104*b* urges pivoting toggle 110*b* to rotate in direction G. Pivoting toggle 110*b* in turn strikes first end 124*b* of retention/release latch 98*b*, causing retention/release latch 98*b* to displace in direction C against the elastic force of spring 128*b*.

Figure 7:
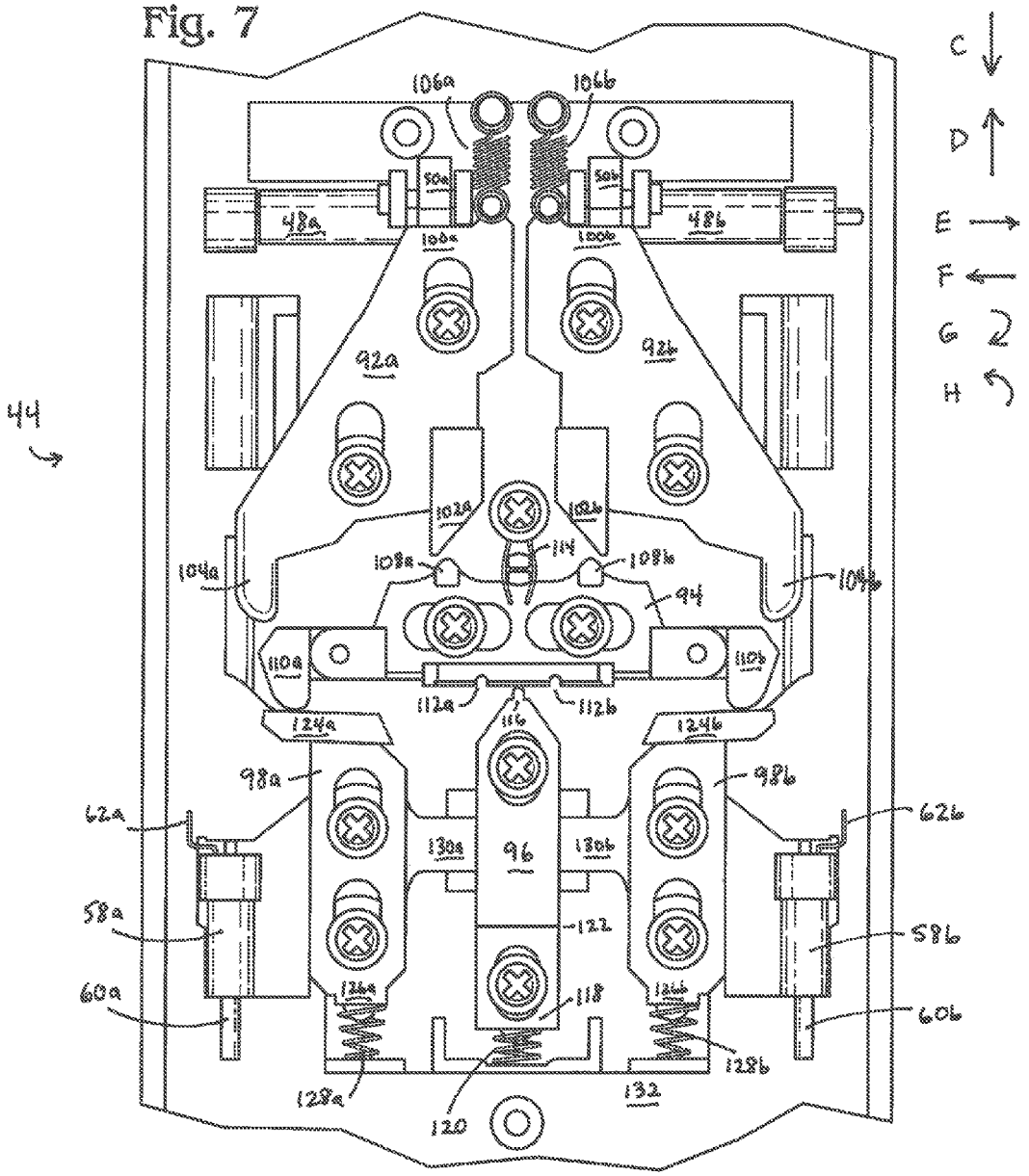
FIG. 7 shows a plan view of a delay type of unlatching assembly located on the underside of an ejector obstacle pair similar to that shown in FIGS. 2 and 3.
Figure 9:
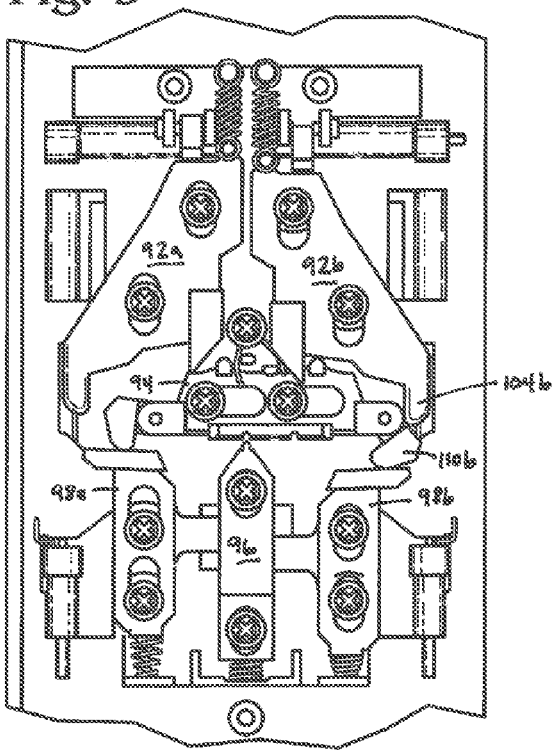
FIG. 9 shows the unlatching assembly of FIG. 7 in a triggered state.

Reset arm 130*b* may protrude at a right angle from retention/release latch 98*b* and may be disposed between shuttle latch 96 and mounting surface 132 as shown in FIGS. 6 and 7. Reset arm 130*b* may be configured with a retention claw (not shown) which may be an L-shaped appendage designed to interlock with associated latching hook 56*b* through an opening in track 12. When retention/release latch 98*b* is urged in direction C, reset arm 130*b* is also urged in direction C, in turn causing the retention claw to disengage from latching hook 56*b* and release ejector 42*b*. FIG. 9 shows a plan view of the previously described components in positions corresponding to a released or triggered state.

Because ejector 42*b* is biased toward second position 66 by hinge spring 62*b*, disengagement of latching hook 56*b* allows panel member 52*b* to forcibly reposition from first position 64 (latched) to second position 66 (open). Additionally, reset arm 130*b* strikes orthogonal transition 122 in shuttle latch 96 (best seen in FIG. 10), thus urging shuttle latch 96 in direction C as well. This motion disengages first end 116 of shuttle latch 96 from arming notch 112*b*. Disengagement allows centering spring 114 to re-center arming shuttle 94.

Conversely, the respective racing positions of toy vehicles in their lanes may be reversed from the scenario just described. A sequence of events from an activation of trigger 40*b* to a later repositioning of ejector 42*a* is therefore now described.

Trigger 40*b* may be activated when a passing first toy vehicle strikes tab portion 46*b*, causing trigger 40*b* to pivot on hinge 48*b* and causing cam portion 50*b* to urge first edge 100*b* of cam follower plate 92*b* in direction C. As before, instead of a spring 51*b* providing elastic resistance to pivoting of trigger 40*b*, spring 106*b* holds cam follower plate 92*b* against cam portion 50*b*, providing elastic resistance and positioning to both components. Cam follower plate 92*b* slidably repositions in direction C, causing angled arming member 102*b* to slide along interface post 108*b*, thereby translating displacement approximately ninety degrees and urging arming shuttle 94 in direction F against elastic resistance from centering spring 114.

Displacement of arming shuttle 94 causes arming notch 112*a* to align with first end 116 of shuttle latch 96. Shuttle latch 96 is biased in direction D by spring 120, resulting in mechanical engagement between first end 116 and arming notch 112*a* once alignment occurs. Mechanical engagement acts to retain arming shuttle 96 in a displaced position despite the biasing resistance of centering spring 114. The retained displacement of arming shuttle 94 also holds pivoting toggle 110*a* at one end of arming shuttle 94 in interposed alignment between firing finger 104*a* and retention/release latch 98*a*. This motion operatively links trigger 40*a* with ejector 42*a*. The example of a delay type unlatching assembly 44 is again in an armed state.

In this example, a subsequent activation of trigger 40*a* causes trigger 40*a* to pivot on hinge 48*a* and causes cam portion 50*a* to urge first edge 100*a* of cam follower plate 92*a* in direction C. Cam follower plate 92*a* slides in direction C as cam follower plate 92*b* did in the previous arming phase. However, since firing finger 104*a* is now aligned with pivoting toggle 110*a*, firing finger 104*a* urges pivoting toggle 110*a* to rotate in direction H. Pivoting toggle 110*a* in turn strikes first end 124*a* of retention/release latch 98*a*, causing retention/release latch 98*a* to displace in direction C against the elastic force of spring 128*a*.

Reset arm 130*a* may protrude at a right angle from retention/release latch 98*a* and may be disposed between shuttle latch 96 and mounting surface 132 as shown in FIGS. 6 and 7. Reset arm 130*a* may be configured with a retention claw (not shown) which may be an L-shaped appendage designed to interlock with associated latching hook 56*a* through an opening in track 12. When retention/release latch 98*a* is urged in direction C, reset arm 130*a* is also caused to move in direction C, in turn causing the retention claw to disengage from latching hook 56*a* and release ejector 42*a*.

Because ejector 42*a* is biased toward second position 66 by hinge spring 62*a*, disengagement of latching hook 56*a* allows panel member 52*a* to forcibly reposition from first position 64 (latched) to second position 66 (open). Additionally, reset arm 130*a* strikes orthogonal transition 122 in shuttle latch 96 (best seen in FIG. 7), thus urging shuttle latch 96 too in direction C and disengaging first end 116 from arming notch 112*a*. Disengagement allows centering spring 114 to re-center arming shuttle 94.

With either of the described types of unlatching assembly 44, the following additional features are noted. Described components of unlatching assembly 44 (with the exception of springs) may be made of any rigid and durable material such as hard plastic or steel. As shown in FIGS. 4-10, the various moving parts may also include slots and/or holes to facilitate guidance or restriction by guide pins or posts which cause associated components to move in the manner described. Any activated obstacle such as ejector 42*a* or ejector 42*b* may be reset for subsequent use by manually moving the obstacle from second position 66 back to first position 64, causing the latching claw of unlatching assembly 44 to interlock with the associated latching hook of the obstacle, thereby retaining the obstacle in first position 64.

Starting Gate

Returning to FIG. 1, an illustrative starting gate 14 is shown disposed proximate first end 22 of track 12. Starting gate 14 may be disposed in any suitable location to allow placement of toy racing vehicles in starting positions and may include a plurality of retention/release members 36 and an activation member 38. The starting gate may be configured to selectively release a plurality of toy vehicles for travel along respective ones of the plurality of lanes 28, such as toward second end 24.

Starting gate 14 may be configured to selectively retain the plurality of toy vehicles proximate first end 22. For example, retention/release members 36 may be configured as tabs that project above traveling surface 34 of lanes 28. Retention/release members 36 may be operatively linked to pivoting activation member 38 below first track segment 26*a* by any suitable linking means configured to substantially change the height of retention/release members 36 above traveling surface 34 upon displacement of activation member 38. For example, there may be a rigid member connecting a lower end of activation member 38 to lower ends of retention/release members 36 such that pivoting of activation member 38 causes a simultaneous change in height of retention/release members 36.

Activation member 38 may be selectively urged toward second end 24, such that the linked retention/release members 36 are lowered relative to traveling surface 34 of lanes 28, which thereby releases the plurality of toy vehicles for travel or racing. Alternatively, the connection between activation member 38 and retention/release members 36 may be through a spring-loaded cam and cam follower mechanism, such lowering of retention/release members 36 is accomplished by urging activation member 38 toward first end 22.

Supports

Still referring to the illustrative toy vehicle racetrack 10 of FIG. 1, a plurality of support members 18 are shown, specifically support member 18*a*, support member 18*b*, and support member 18*c*. Each support member may be configured to provide rigid support at a preselected height, such that the overall orientation of track 12 is in a downward sloping orientation from a maximum height at first end 22 and a minimum height at second end 24. Any one of support members 18 may be hingeably connected to a corresponding track segment.

Alternatively, as seen in support member 18*c*, support members 18 may be rigidly or integrally formed as part of track 12. One purpose of hinged connections in this context is to allow larger support members 18 to be folded against track 12 for storage or portability purposes. Support members 18 may consist of independent support structures for each side of toy vehicle racetrack 10, or the support structures on each side of toy vehicle racetrack 10 may be connected by one or more cross-pieces to provide stability and facilitate deployment.

Configurations

Figure 11:
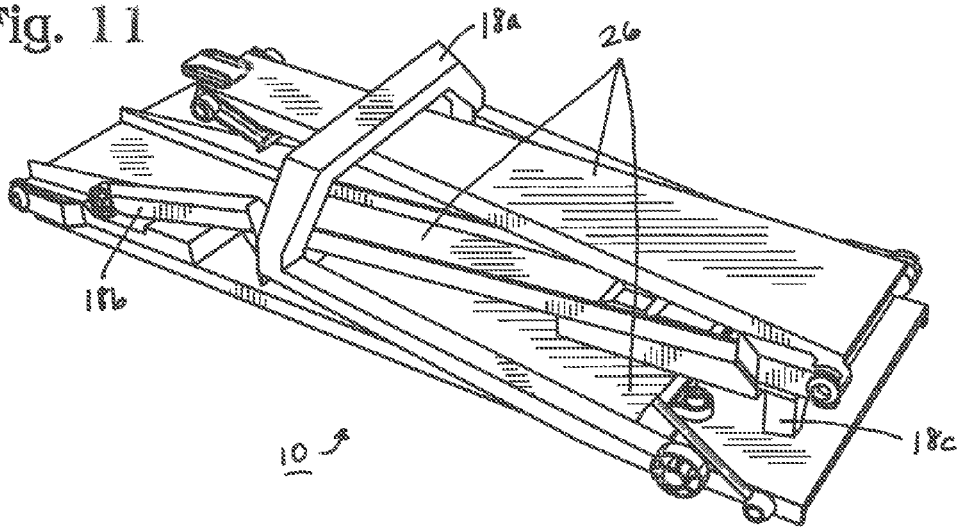
FIG. 11 shows a view of a toy vehicle racetrack folded into traveling configuration.
Figure 10:
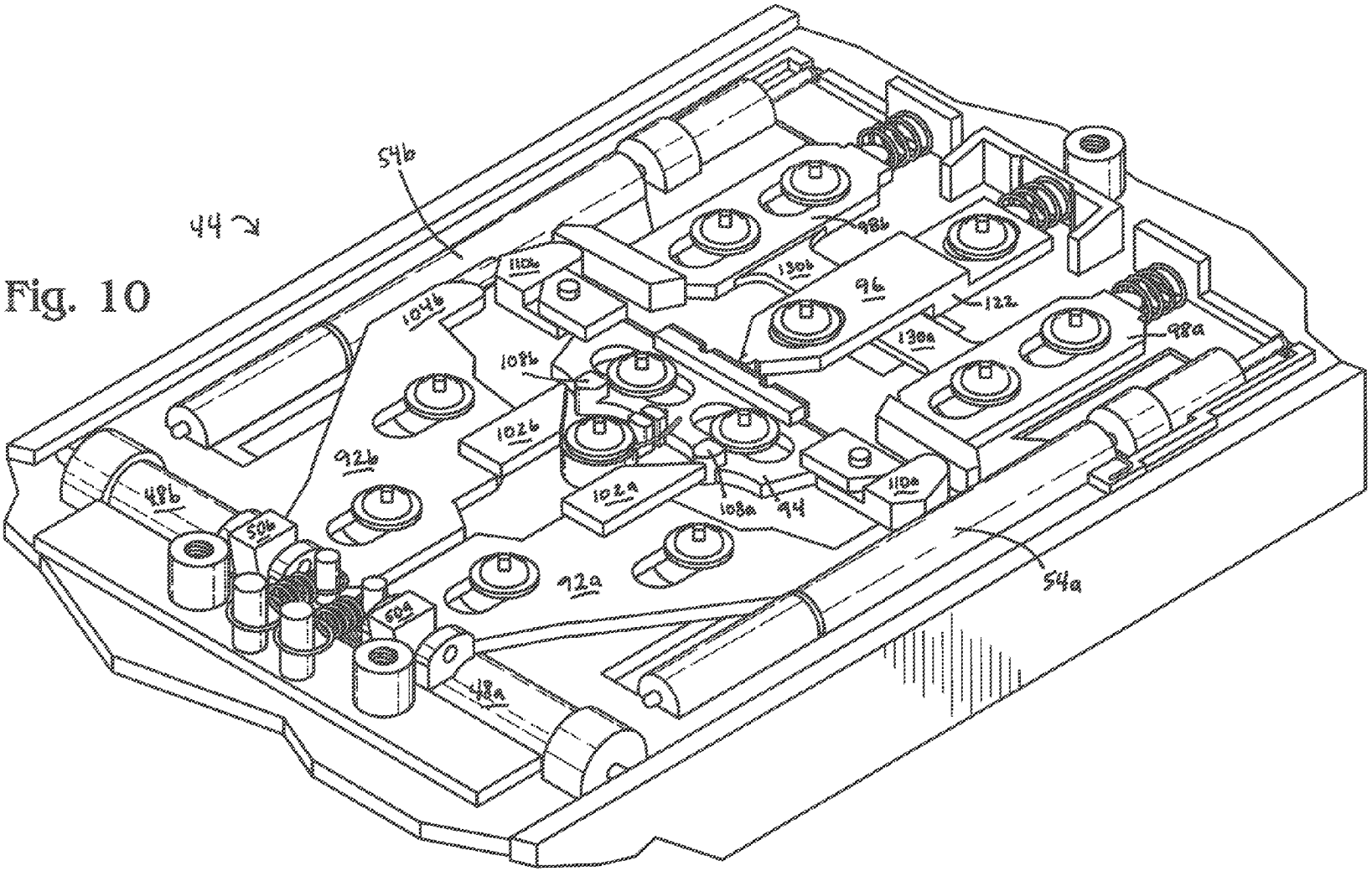
FIG. 10 shows a perspective view of the unlatching assembly of FIG. 7.

In some examples, track segments 26 are hingeably and disconnectably attached to previous and following track segments 26. Combined with the folding feature of support members 18, this connection method allows toy vehicle racetrack 10 to be collapsed into a travel configuration as shown in FIG. 11. Disconnectable hinges may be formed by providing a two-pronged C-shaped structure at each side of a terminal end of a first track segment. Each two-pronged structure is configured to reversibly friction fit over a pin protruding from a first end of second track segment. Each pin is sized with an outer diameter similar to the inner diameter of the C-shaped structure. In addition to the benefits of convenience and collapsibility, disconnectable friction-fit hinges may act as breakaway mechanism for enhanced safety. For example, if a person were to accidentally step on toy vehicle racetrack 10, the disconnectable hinges may allow the track segments 26 to come apart rather than breaking. Similarly, if a user's fingers were to be pinched between track segments 26, disconnectable hinges may come apart prior to causing injury.

Furthermore, male and female connection members may be included on any portion of toy vehicle racetrack 10 to allow additional race track components to be added by a user or to allow portions of toy vehicle racetrack 10 to be integrated into other play structures. For example, the terminal end of track segment 26*c* may include male connectors configured to allow additional lengths of track to be added. In another example, obstacle pairs 16 may be made available for modular use in other racetracks by including suitable male and female connection points to allow integration into user-configured tracks and raceways.

Finishing Gate

In some examples, toy vehicle racetrack 10 includes finishing gate 20. Finishing gate 20 may be any suitable structure configured to indicate that a toy vehicle has victoriously reached second end 24 of track 12. For example, finishing gate 20 may be a simple pivoting flag 134 configured such that when a passing toy vehicle strikes a first end of flag 134, flag 134 is urged to pivot away from the vehicle, causing a second end of flag 134 to pivot from a lowered position to a raised position. Alternatively, for example in toy vehicle racetracks which have multiple lanes and multiple vehicles at second end 24, finishing gate 20 may be any finish line indicator configured to show either which vehicle finished first or a complete order of vehicle placement at the finish line. Examples of a multi-lane finishing gate 20 are disclosed in U.S. Pat. Nos. 5,651,736, 4,715,602, 3,618,947, 3,502,332, 3,376,844, 3,315,632, and 1,662,162.

In view of the previous description, at least one embodiment includes a toy racetrack 10 comprising a first lane 28 for a first toy vehicle and a second lane 28 for a second toy vehicle; an obstacle pair 16 having two operatively linked obstacles, for example ejector 42*a* and ejector 42*b* shown in FIGS. 2 and 3, including a first obstacle located substantially in line with the first lane 28 and a second obstacle located substantially in line with the second lane 28; wherein each obstacle has at least a first position 64 which allows unimpeded travel and a second position 66 which impedes travel. The illustrative embodiment may further include a first trigger 40*a*, where activation of the first trigger 40*a* results in substantially immediate repositioning of the second obstacle from the first position 64 to the second position 66, and activation of the first trigger 40*a* may include interaction between a toy vehicle and the first trigger 40*a*. In one illustrative embodiment, the first obstacle includes a first trigger 40*a*; the second obstacle includes a second trigger 40*b*; activation of the first trigger 40*a* places the obstacle pair 16 into an intermediate armed state; activation of the second trigger 40*b* while the obstacle pair 16 is in an intermediate armed state results in substantially immediate repositioning of the second obstacle from the first position 64 to the second position 66. In this example, activation of a trigger 40*a* or 40*b* includes interaction between a toy vehicle and the trigger, and impeding travel includes ejecting a toy vehicle from a lane 28.

One of the disclosed embodiments includes a toy racetrack 10 with a divided traveling surface 34 having at least a first portion 26*a* with four lanes 28 and two obstacle pairs 16, connected to a second portion 26*b* with two lanes, as shown in FIG. 1. Preferably, each obstacle pair 16 is located substantially in a corresponding pair of lanes 28, and each obstacle in each obstacle pair 16 is movable from at least a first position 64 to a second position 66. Still further, each obstacle in each obstacle pair 16, when in the first position 64, allows unimpeded travel, and when in the second position 66, impedes travel. In some embodiments, each pair of lanes 28 transitions from two lanes 28 before the obstacle pair 16 to one lane 28 after the obstacle pair, and at least one obstacle pair 16 is configured such that activation of the obstacle pair 16 by a toy vehicle causes travel of a toy vehicle in one of the lanes 28 to be impeded.

In another disclosed embodiment, a toy vehicle obstacle apparatus includes a first lane 28 for a first toy vehicle and a second lane 28 for a second toy vehicle. The apparatus may include a first trigger 40*a* in the first lane 28, a second trigger 40*b* in the second lane 28, a first obstacle, such as the non-limiting example of ejector 42*a*, in the first lane 28, the first obstacle movable between a first position 64 which allows unimpeded travel in the first lane 28 and a second position 66 which impedes travel in the first lane 28; a second obstacle, such as the non-limiting example of ejector 42*b*, in the second lane 28, the second obstacle movable between a first position 64 which allows unimpeded travel in the second lane 28 and a second position 66 which impedes travel in the second lane 28; an unlatching assembly 44 operatively coupled to the first trigger 40*a*, the second trigger 40*b*, the first obstacle, and the second obstacle; wherein the first trigger 40*a* causes the unlatching assembly 44 to release the second obstacle, causing the second obstacle to move from the first position 64 to the second position 66; and the second trigger 40*a* causes the unlatching assembly 44 to release the first obstacle, causing the first obstacle to move from the first position 64 to the second position 66. An example of an unlatching assembly 44 of this embodiment is shown in FIGS. 4-6.

Yet another embodiment includes a toy vehicle obstacle apparatus with a first lane 28 for a first toy vehicle and a second lane 28 for a second toy vehicle. The apparatus includes a first trigger 40*a* in the first lane 28, a second trigger 40*b* in the second lane 28, a first obstacle such as the non-limiting example of ejector 42*a*, in the first lane, the first obstacle movable between a first position 64 which allows unimpeded travel in the first lane 28 and a second position 66 which impedes travel in the first lane 28; and a second obstacle, such as the non-limiting example of ejector 42*b*, in the second lane 28, the second obstacle movable between a first position 64 which allows unimpeded travel in the second lane 28 and a second position 66 which impedes travel in the second lane 28. As shown in FIGS. 7-10, this embodiment includes an arming shuttle 94 operatively connected to the first trigger 40*a* and the second trigger 40*b*; wherein a first activation of the first trigger 40*a* causes the arming shuttle 94 to operatively connect the second trigger 40*b* to the second obstacle; and a subsequent second activation of the second trigger 40*b* releases the second obstacle, causing the second obstacle to move from the first position 64 to the second position 66.

It is believed that the disclosure set forth herein encompasses multiple distinct inventions with independent utility. While each of these inventions has been disclosed in its preferred form, the specific embodiments thereof as disclosed and illustrated herein are not to be considered in a limiting sense as numerous variations are possible. Each example defines an embodiment disclosed in the foregoing disclosure, but any one example does not necessarily encompass all features or combinations that may be eventually claimed. Where the description recites "a" or "a first" element or the equivalent thereof, such description includes one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically stated.

We claim:

1. A toy racetrack comprising:

a divided travelling surface having at least a first portion with four lanes and two obstacle pairs, connected to a second portion with two lanes;

wherein:

each obstacle pair is located substantially in a corresponding pair of lanes, each obstacle in each obstacle pair is movable, independent of the other obstacle in the obstacle pair, from at least a first position, in which the respective obstacle allows unimpeded travel, to a second position, in which the respective obstacle impedes travel;

each pair of lanes transitions from two lanes before the obstacle pair to one lane after the obstacle pair; and at least one obstacle pair is configured such that activation of the obstacle pair by a first toy vehicle causes travel of a second toy vehicle in one of the lanes to be impeded.

2. The toy racetrack of claim 1, wherein the first toy vehicle is a leading toy vehicle and the second toy vehicle is a trailing toy vehicle.

3. The toy racetrack of claim 1, wherein at least one of the obstacle pairs is configured such that activation by the first toy vehicle impedes the travel of the second toy vehicle substantially immediately.

4. The toy racetrack of claim 1, wherein at least one of the obstacle pairs is configured such that a first activation by the first toy vehicle places the obstacle pair into an intermediate armed state, and a second activation by the second toy vehicle causes the obstacle pair to impede the travel of the second toy vehicle.

5. The toy racetrack of claim 1, wherein the travel of the second toy vehicle is impeded by ejecting the second toy vehicle from the traveling surface.

6. A toy vehicle obstacle apparatus comprising:

a first lane for a first toy vehicle and a second lane for a second toy vehicle;

a first trigger in the first lane;

a second trigger in the second lane;

a first obstacle in the first lane, the first obstacle being movable between a first position which allows unimpeded travel in the first lane and a second position which impedes travel in the first lane;

a second obstacle in the second lane, the second obstacle being movable, independent of the position of the first obstacle, between a first position which allows unimpeded travel in the second lane and a second position which impedes travel in the second lane;

an unlatching assembly operatively coupled to the first trigger, the second trigger, the first obstacle, and the second obstacle;

wherein the first trigger causes the unlatching assembly to release the second obstacle, causing the second obstacle to move from the first position to the second position; and the second trigger causes the unlatching assembly to release the first obstacle, causing the first obstacle to move from the first position to the second position.

7. The toy vehicle obstacle apparatus of claim 6, wherein a trigger comprises a pivoting cam member located at least partially in the path of toy vehicle travel.

8. The toy vehicle obstacle apparatus of claim 7, wherein the unlatching assembly comprises a first cam follower operatively connected to a first cam surface of the first trigger, a second cam follower operatively connected to a second cam surface of the second trigger, and a toggle member operatively connected to both cam followers such that operation of the first trigger and first cam follower causes the toggle member to unlatch the obstacle in the second lane.

9. The toy vehicle obstacle apparatus of claim 6, wherein the first obstacle comprises a spring-loaded, hinged member.

10. The toy vehicle obstacle apparatus of claim 6, wherein the first obstacle comprises a spring-loaded section of the traveling surface.

11. The toy vehicle obstacle apparatus of claim 6, wherein the first obstacle comprises a releasable net-shaped object.

12. The toy vehicle obstacle apparatus of claim 6, further comprising connector members configured to allow the toy vehicle obstacle apparatus to be assembled with additional interchangeable racetrack components.

13. A toy vehicle obstacle apparatus comprising:

a first lane for a first toy vehicle and a second lane for a second toy vehicle;

first trigger in the first lane;

a second trigger in the second lane;

a first obstacle in the first lane, the first obstacle being movable between a first position which allows unimpeded travel in the first lane and a second position which impedes travel in the first lane;

a second obstacle in the second lane, the second obstacle being movable, independent of the position of the first obstacle, between a first position which allows unimpeded travel in the second lane and a second position which impedes travel in the second lane;

an arming shuttle operatively coupled to the first trigger and the second trigger;

wherein the arming shuttle is configured such that a first activation of the first trigger causes the arming shuttle to operatively connect the second trigger to the second obstacle, and a subsequent second activation of the second trigger releases the second obstacle, causing the second obstacle to move from the first position to the second position.

14. The toy vehicle obstacle apparatus of claim 13, wherein a trigger comprises a pivoting cam member located at least partially in the path of toy vehicle travel.

15. The toy vehicle obstacle apparatus of claim 13, wherein the first obstacle comprises a spring-loaded, hinged member.

16. The toy vehicle obstacle apparatus of claim 13, wherein the first obstacle comprises a spring-loaded section of the traveling surface.

17. The toy vehicle obstacle apparatus of claim 13, wherein the first obstacle comprises a releasable net-shaped object.

18. The toy vehicle obstacle apparatus of claim 13, further comprising connectors and receptacles wherein said connectors and receptacles allow the toy vehicle obstacle apparatus to be assembled with additional interchangeable racetrack components.

19. A toy racetrack comprising a first lane for a first toy vehicle and a second lane for a second toy vehicle;

an obstacle pair having two operatively linked obstacles: a first obstacle located substantially in line with the first lane and a second obstacle located substantially in line with the second lane;

wherein each obstacle is movable, independent of the position of the other obstacle, between at least a first position which allows unimpeded travel and a second position which impedes travel.

20. The toy racetrack of claim 19, wherein the first obstacle comprises a first trigger; and activation of the first trigger results in substantially immediate repositioning of the second obstacle from the first position to the second position.

* * * * *